US012234719B2

(12) United States Patent
Kabannik

(10) Patent No.: US 12,234,719 B2
(45) Date of Patent: Feb. 25, 2025

(54) METHODS FOR DETERMINING A POSITION OF A DROPPABLE OBJECT IN A WELLBORE

(71) Applicant: Schlumberger Technology Corporation, Sugar Land, TX (US)

(72) Inventor: Artem Valeryevich Kabannik, Novosibirsk (RU)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 101 days.

(21) Appl. No.: 18/007,316

(22) PCT Filed: Jul. 30, 2020

(86) PCT No.: PCT/RU2020/000405

§ 371 (c)(1),
(2) Date: Jan. 30, 2023

(87) PCT Pub. No.: WO2022/025790

PCT Pub. Date: Feb. 3, 2022

(65) Prior Publication Data

US 2023/0304395 A1 Sep. 28, 2023

(51) Int. Cl.

| | |
|---|---|
| ***E21B 47/095*** | (2012.01) |
| ***E21B 33/14*** | (2006.01) |
| ***E21B 47/06*** | (2012.01) |

(52) U.S. Cl.

CPC ..... *E21B 47/095* (2020.05); *E21B 33/14* (2013.01); *E21B 47/06* (2013.01)

(58) Field of Classification Search

CPC ..... E21B 47/095; E21B 47/06; E21B 47/09; E21B 47/12; E21B 33/14

See application file for complete search history.

(56) References Cited

U.S. PATENT DOCUMENTS

| | | | |
|---|---|---|---|
| 4,819,726 | A | 4/1989 | Beirute |
| 5,754,495 | A | 5/1998 | Skinner |

(Continued)

FOREIGN PATENT DOCUMENTS

| | | | |
|---|---|---|---|
| RU | 2225499 | C2 | 3/2004 |
| RU | 2351746 | C2 | 4/2009 |

(Continued)

OTHER PUBLICATIONS

"Kalman Filter" in Wikipedia; downloaded from the internet at [Kalman Filter https/Zm.wikipedia.org] on Apr. 19, 2024, 16 pages.

(Continued)

*Primary Examiner* — George S Gray
(74) *Attorney, Agent, or Firm* — Jeffrey D. Frantz

(57) ABSTRACT

The position of a droppable object (e.g., a cementing plug or drillpipe dart) in a cased wellbore may be determined in real time during a cementing operation. A pressure data acquisition system is installed at a wellsite and a pressure transducer is installed at the cementing head. As the droppable object travels through casing it encounters regions with a positive or a negative change of inner cross-sectional dimension. The droppable object generates a pressure pulse as it passes through the regions. The pressure pulse and associated reflections are detected by the pressure transducer, and the signals are processed mathematically by a Kalman filter to determine the current position of the droppable object.

9 Claims, 11 Drawing Sheets

(56) References Cited

U.S. PATENT DOCUMENTS

| | | | | |
|---|---|---|---|---|
| 6,125,935 | A | 10/2000 | Shahin, Jr. | |
| 6,308,562 | B1 * | 10/2001 | Abdallah | E21B 47/18 340/856.4 |
| 6,401,814 | B1 * | 6/2002 | Owens | E21B 33/16 166/250.14 |
| 9,453,404 | B2 | 9/2016 | Shampine | |
| 9,546,548 | B2 | 1/2017 | Hartog | |
| 2002/0157828 | A1 * | 10/2002 | King | E21B 47/01 166/250.14 |
| 2009/0216455 | A1 * | 8/2009 | Reckmann | E21B 47/007 702/9 |
| 2010/0095759 | A1 * | 4/2010 | Besson | G01L 19/0609 73/152.51 |
| 2016/0230533 | A1 * | 8/2016 | Steele | E21B 17/00 |
| 2017/0096891 | A1 * | 4/2017 | Gao | E21B 47/24 |
| 2017/0218744 | A1 * | 8/2017 | Dykstra | E21B 47/09 |
| 2017/0342823 | A1 * | 11/2017 | Shah | E21B 33/12 |
| 2019/0186253 | A1 * | 6/2019 | Peter | E21B 47/024 |

FOREIGN PATENT DOCUMENTS

| | | | |
|---|---|---|---|
| WO | 2018004369 | A1 | 1/2018 |
| WO | 2021040556 | A1 | 3/2021 |

OTHER PUBLICATIONS

Office Action issued in Eurasian Patent Application No. 202390197 dated Dec. 18, 2023, 4 pages with English translation.

International Search Report and Written Opinion issued in International Patent application PCT/RU2020/000405 on Apr. 22, 2021, 7 pages.

Leugemors E. et al.: "Cementing Equipment and Casing Hardware," in Nelson EB and Guillot D (eds.): Well Cementing—2nd Edition, Houston, Schlumberger, 2006, pp. 343-458.

Piot B. and Cuvillier G., "Primary Cementing Techniques," in Nelson EB and Guillot D (eds.): Well Cementing—2nd Edition, Houston, Schlumberger, 2006, pp. 459-501.

Trogus M: "Studies of Cement Wiper Plugs Suggest New Deepwater Standards," paper SPE/IADC-173066-MS, presented at the SPE/IADC Drilling Conference and Exhibition, London, UK, Mar. 17-19, 2015, 9 pages.

Kalman, R. E. "A New Approach to Linear Filtering and Prediction Problems". Journal of Basic Engineering. 82: 1960, pp. 35-45.

* cited by examiner

METHODS FOR DETERMINING A POSITION OF A DROPPABLE OBJECT IN A WELLBORE

Cross-Reference To Related Applications

This application is the National Stage Entry of International Application No. PCT/RU2020/000405, filed Jul. 30, 2020.

TECHNICAL FIELD

The present disclosure relates generally to cementing operations. In particular, the disclosure relates to using volumetric measurements, reflected tube waves and pressure pulses to determine the positions of wiper plugs and drillpipe darts inside a casing string.

BACKGROUND

During the construction of underground wells, it is common, during and after drilling, to place a tubular body such as a liner or casing, secured by cement pumped into the annulus around the outside of the tubular body. The cement serves to support the tubular body and to provide isolation of the various fluid-producing zones through which the well passes. This latter function prevents cross-contamination of fluids from different layers. For example, the cement prevents formation fluids from entering the water table and polluting drinking water, or prevents water from passing into the well instead of oil or gas. Furthermore, the cement sheath helps prevent corrosion of the tubular body.

The cement placement process is known in the industry as primary cementing. Most primary cementing operations employ the two-plug cement-placement method. FIG. 1 shows a typical wellsite configuration 100 for a primary cementing operation. A cementing head 101 is situated on the surface, and a casing string 103 is lowered into a borehole 102. As the casing string 103 is lowered into the borehole 102, the casing string interior fills with drilling fluid 108. The casing string is centered in the borehole by centralizers 104 attached to the outside of the casing string. Centralizers are placed in critical casing sections to prevent sticking while the casing is lowered into the well. In addition, they keep the casing string in the center of the borehole to help ensure placement of a uniform cement sheath in the annulus between the casing and the borehole. The bottom end of the casing string is protected by a guide shoe 105 and a float collar 109. Guide shoes are tapered, commonly bullet-nosed devices that guide the casing toward the center of the hole to minimize hitting rough edges or washouts during installation. The guide shoe differs from the float collar in that it lacks a check valve. The check valve in a float collar can prevent reverse flow, or U-tubing, of fluids from the annulus into the casing. Inside the cementing head 101 are a bottom cementing plug 106 and a top cementing plug 107. The cementing plugs, also known as cementing wiper plugs or wiper plugs, are elastomeric devices that provide a physical barrier between different fluids as they are pumped through the casing string interior. Most cementing plugs are made of a cast aluminum body with molded rubber fins that ensure steady movement through a tubing.

The goals of the primary cementing operation are to remove drilling fluid from the casing interior and borehole, place a cement slurry in the annulus, and leave the casing interior filled with a displacement fluid such as brine or water. The bottom cementing plug 106 separates the cement slurry from the drilling fluid, and the top cementing plug 107 separates the cement slurry from the displacement fluid.

Cement slurries and drilling fluids are usually chemically incompatible. Commingling may result in a thickened or gelled mass at the interface that would be difficult to remove from the wellbore, possibly preventing the placement of a uniform cement sheath throughout the annulus. Therefore, in addition to using wiper plugs, engineers employ both chemical means to maintain fluid separation. Chemical washes and spacer fluids may be pumped between the cement slurry and drilling fluid. These fluids have the added benefit of cleaning the casing and formation surfaces, which is helpful for achieving good bonding with the cement.

FIG. 2 shows a chemical wash 201 and a spacer fluid 202 being pumped between the drilling fluid 103 and the bottom cementing plug 106. Cement slurry 203 follows the bottom cementing plug. The bottom cementing plug has a membrane that ruptures when it lands at the bottom of the casing string, allowing cement slurry to pass through the bottom cementing plug and enter the annulus (FIG. 3).

Once a sufficient volume of cement slurry has been pumped to fill the annular region between the casing string and the borehole wall, the top cementing plug 107 is released, followed by the displacement fluid 301. The top cementing plug 107 does not have a membrane; therefore, when it lands, hydraulic communication is severed between the casing interior and the annulus (FIG. 4). After the cementing operation, engineers wait for the cement to set and develop strength—known as "waiting-on-cement" (WOC). After the WOC time, further operations such as drilling deeper or perforating the casing string may commence.

Conventional cementing plugs are pumped directly from the surface because they pass through only one pipe with a continuous inside diameter (ID). Liners, on the other hand, do not begin at the surface; instead, they are run downhole on the drillstring to the setting depth. Liners typically have a much larger ID than the drillstring; as a result, a single cementing plug cannot be pumped from the surface. Therefore, the displacement is performed by two plugs. One plug, known as the drillpipe dart, is located in the surface cementing equipment. The second plug is either attached to the bottom of the liner setting tool assembly, or the top of the liner setting tool assembly. The second plug is called a liner wiper plug.

After the cement has been pumped in the liner and the drillstring, the drillpipe dart is released from the surface cementing equipment. When the drillpipe dart reaches the top of the liner, it latches into the liner wiper plug. Both the drillpipe dart and the liner wiper plug then become a single divider between the cement slurry and the displacement fluid. This arrangement may be seen in extended-reach wells and multistage cementing applications.

Additional information concerning cementing plugs, drillpipe darts and primary cementing operations may be found in the following publications. Leugemors E et al.: "Cementing Equipment and Casing Hardware," in Nelson E B and Guillot D (eds.): *Well Cementing—2nd Edition*, Houston, Schlumberger (2006) 343-458. Piot B and Cuvillier G: "Primary Cementing Techniques," in Nelson E B and Guillot D (eds.): *Well Cementing—2nd Edition*, Houston, Schlumberger (2006) 459-501. Trogus M: "Studies of Cement Wiper Plugs Suggest New Deepwater Standards," paper SPE/IADC-173066-MS, presented at the SPE/IADC Drilling Conference and Exhibition, London, UK, 17-19 Mar. 2015.

Deviations from the idealized cementing operation depicted above may occur. Possible reasons include borehole rugosity leading to inaccurate displacement volume calculations, pump rate fluctuations, differences between nominal and actual casing geometry, lost circulation, casing deformation and fluid loss. With these uncertainties, operators and engineers are motivated to achieve real-time monitoring of cementing plug positions, as well as locate the top of the cement (TOC) sheath in the annulus.

The present disclosure relates to a real-time method for detecting the position of a downhole object in wellbore during liner or casing cementing operations. As discussed above, oil or gas well cementing is the process of pumping cement slurry to the annular space between the well-bore and casing or between two successive casing strings with a purpose to provide well integrity via zonal isolation and wellbore strengthening. During a primary cementing operation the cement slurry is pumped into the casing and then displaced by another fluid. At the end of the displacement the top cement plug bumps on the landing collar on the bottom of the wellbore and isolates the inner casing space filled with the displacement fluid from annulus filled with the cement slurry. This moment may be indicated by a pressure rise at the surface. The cementing operation may be considered to be completed.

Traditionally, the plug position may be tracked by dividing the displaced fluid volume by the casing cross sectional area. The displaced volume may be measured by a surface flowmeter or by counting the cementing pump strokes. The casing cross sectional area may be calculated from the inner casing diameter. This method of cement plug monitoring based on tracking pumped will hereinafter be referred to as the volumetric method.

The cement pumping and displacement processes may become problematic due to incorrect calculations of displacement volume, inaccurate control of pumping rate, differences between nominal and actual casing geometry, lost circulation, casing deformation, fluid by-pass, etc. As a result, the actual positions of a cementing plug and top of cement may differ from theoretical predictions. Accordingly, there is a need in the art to have methods for monitoring cementing plug and top of cement positions during a cementing operation to recognize possible issues in timely manner and take appropriate remedial actions.

A method and system for locating steady downhole objects that reflect a hydraulic signal are disclosed in the patent application WO 2018/004369. The monitoring of the well is based on cepstral analysis of pressure data recorded at the wellhead. It is designed to locate steady downhole objects that reflect a hydraulic signal. A hydraulic signal is detected by a pressure sensor, then the pressure data are processed to obtain their properties such as tube wave reflection times. One (but not the only) method of obtaining such information is a cepstrum analysis. The cepstrum analysis is widely used in various applications, for example for hydraulic fracturing operations monitoring. As described in patent application WO 2018/004369 referenced above, a cepstrum is the result of taking the inverse Fourier transform (IFT) of the logarithm of the estimated spectrum of a signal. The cepstrogram allows detection of objects that reflect the hydraulic signal. This method for hydraulic fracturing operations uses hydraulic signal sources including the water hammer effect, noise from surface or submersible pumps and perforating events.

U.S. Pat. No. 6,401,814 B1 discloses a method for locating a cementing plug in a subterranean well during cementing operations using pressure pulse reflections. Once generated, pressure pulses are transmitted through displacement fluid, reflected off the cementing plug and, finally, received by a pressure sensor. A location of the plug is calculated from reflection time and pressure pulse velocity in the given media. The method of generating and transmitting of pressure pulse through the fluid in a casing string comprises momentarily opening a valve installed in the flowline of the well. Other methods of pressure pulse generation include an air gun, varying the pump's engine speed or disengaging the pump.

U.S. Pat. No. 4,819,726 discloses a method for indicating the position of a cement wiper plug prior to its bottomhole arrival. It comprises an apparatus that includes a section of pipe string with an interior shearable, temporary means of restricting the motion of the cement wiper plug through the section of pipe string. The arrival of the cementing plug at the shearable, temporary restriction means in a pipe string is sensed by an increase in pipe string pressure at the surface and monitored by a pressure sensor.

U.S. Pat. No. 9,546,548 discloses a device and a method of use for cement sheath analysis based on acoustic wave propagation. It consists of an acoustic wave detection apparatus, comprising a fiber optic cable drawn down in a well, an optical source and a data acquisition system. The acoustic source produces a compressional wave in a casing string. The pressure in the annulus is determined as the cement slurry sets, and this pressure is compared to the maximum formation pressure as an indication of whether the cement had set to a strength, enough to maintain an effective formation-to-casing seal across the annulus.

Plug tracking methods based on analysis of tube wave signal propagating in the wellbore were disclosed in PCT/RU2019/000600.

1. Downhole object position determination by pressure pulse correlation with a casing tally. The pulses are determined by spectral analysis of high-resolution cement head pressure data.
2. Downhole object position determination by reflection time measurement. The reflection times are determined from a pressure cepstrogram.

These methods are based on the analysis of the pressure signal recorded with high resolution at the cement head and potentially have better accuracy than the volumetric method. However, the tube wave signal is not always observed at the cement head sensor during the cementing operation. For example, in the beginning of the cement displacement, more dense cement slurry below the plug may depressurize the portion of the wellbore above the plug, preventing the tube wave signal from propagating. This is referred to as a "U-tubing effect." Additionally, the pressure pulses may not be generated when the plug moves at low speed.

The concept of combining of sensor data or data derived from disparate sources has been used in applications such as car, space- or aircraft navigation, traffic monitoring systems and autonomous driving. This approach is referred to as "data fusion," and may result in lower measurement uncertainty than would be possible if these sources were used individually.

The disclosure pertains to detecting a plug in a wellbore during cementing operations by data fusion of different plug position measurements by the Kalman filter algorithm. This results in more accurate object position estimation than those based on a single measurement alone. This is achieved by estimating a joint probability distribution over the measurement results for each timeframe.

SUMMARY

Figure 1:
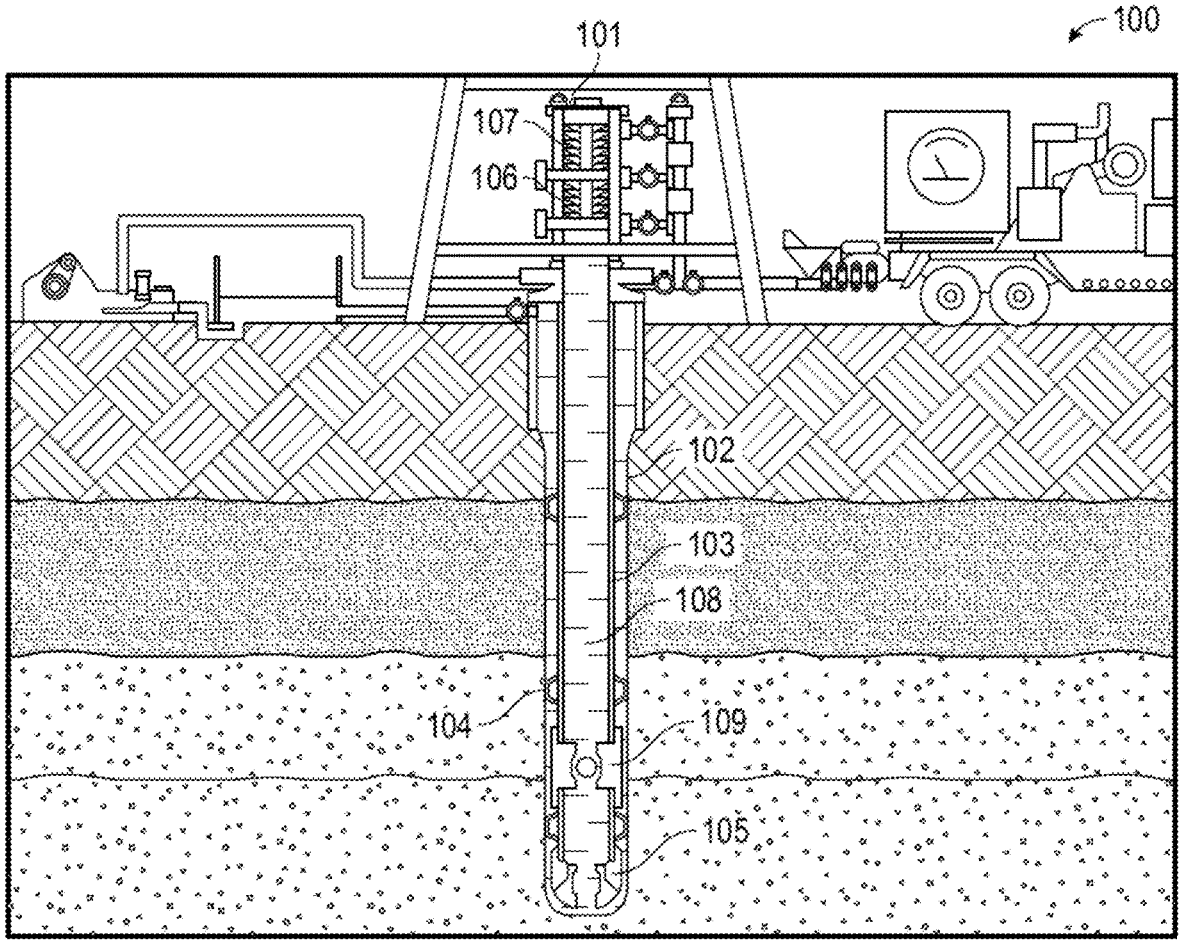
FIG. 1 shows a typical wellsite configuration during a cementing operation.
Figure 2:
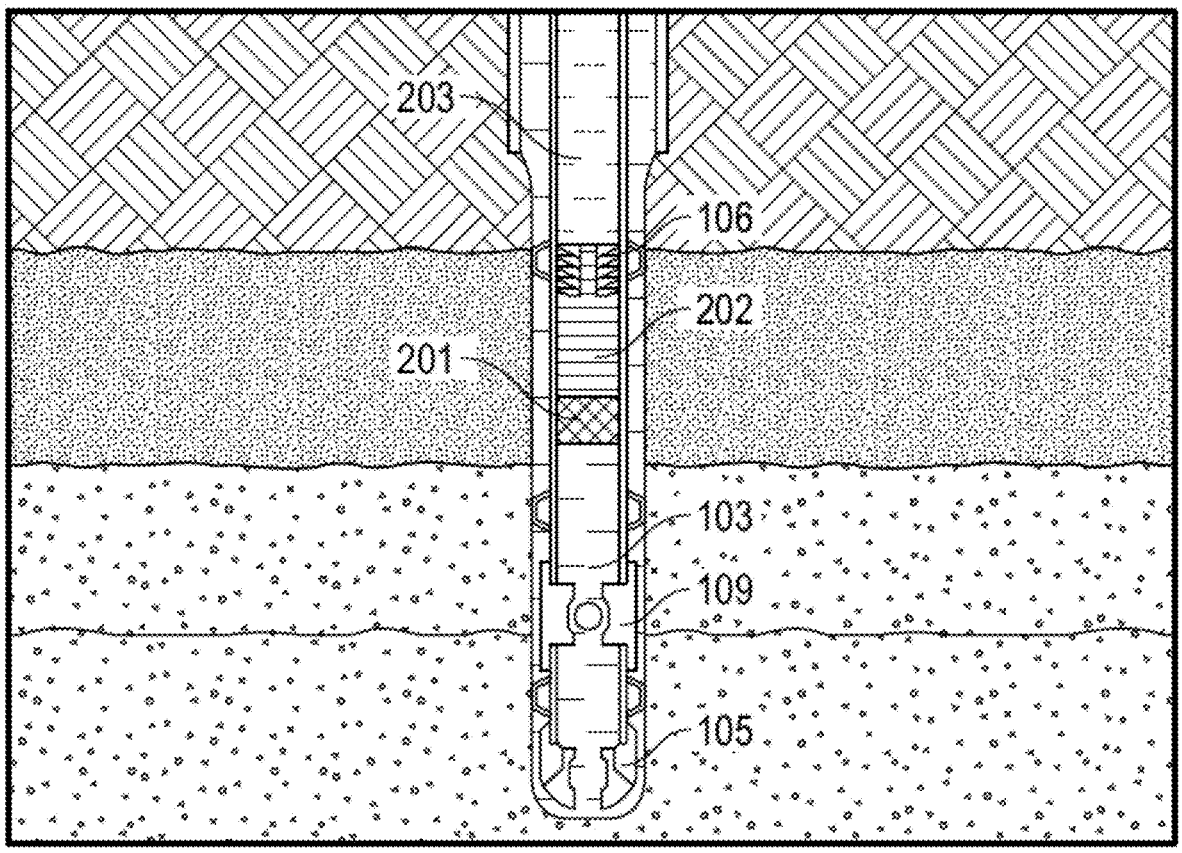
FIG. 2 shows a cementing operation in progress. The bottom cementing plug has been released, separating the cement slurry from chemical washes, spacer fluids and drilling fluid.
Figure 3:
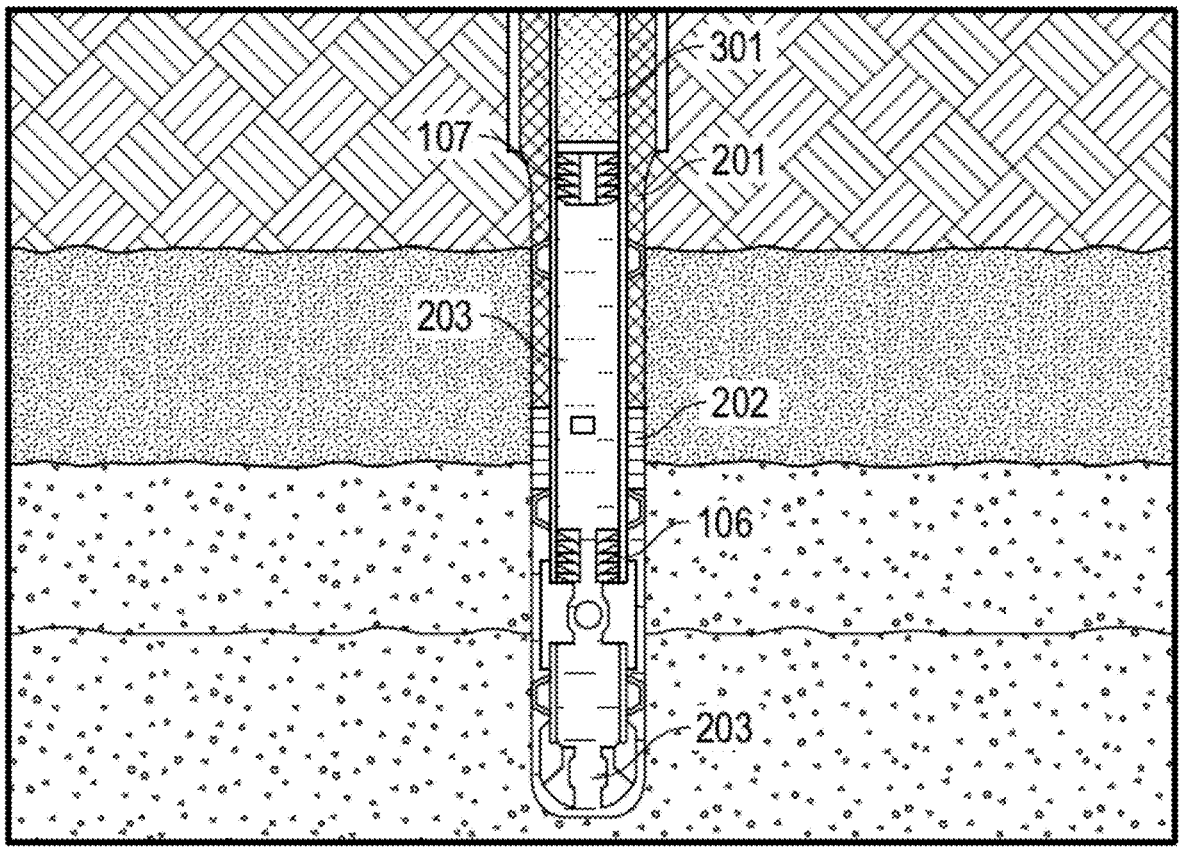
FIG. 3 shows a cementing operation in progress. The bottom cementing plug has landed on the float collar. A membrane in the bottom cementing plug ruptures, allowing cement slurry to enter the annulus between the casing string and the borehole wall.
Figure 4:
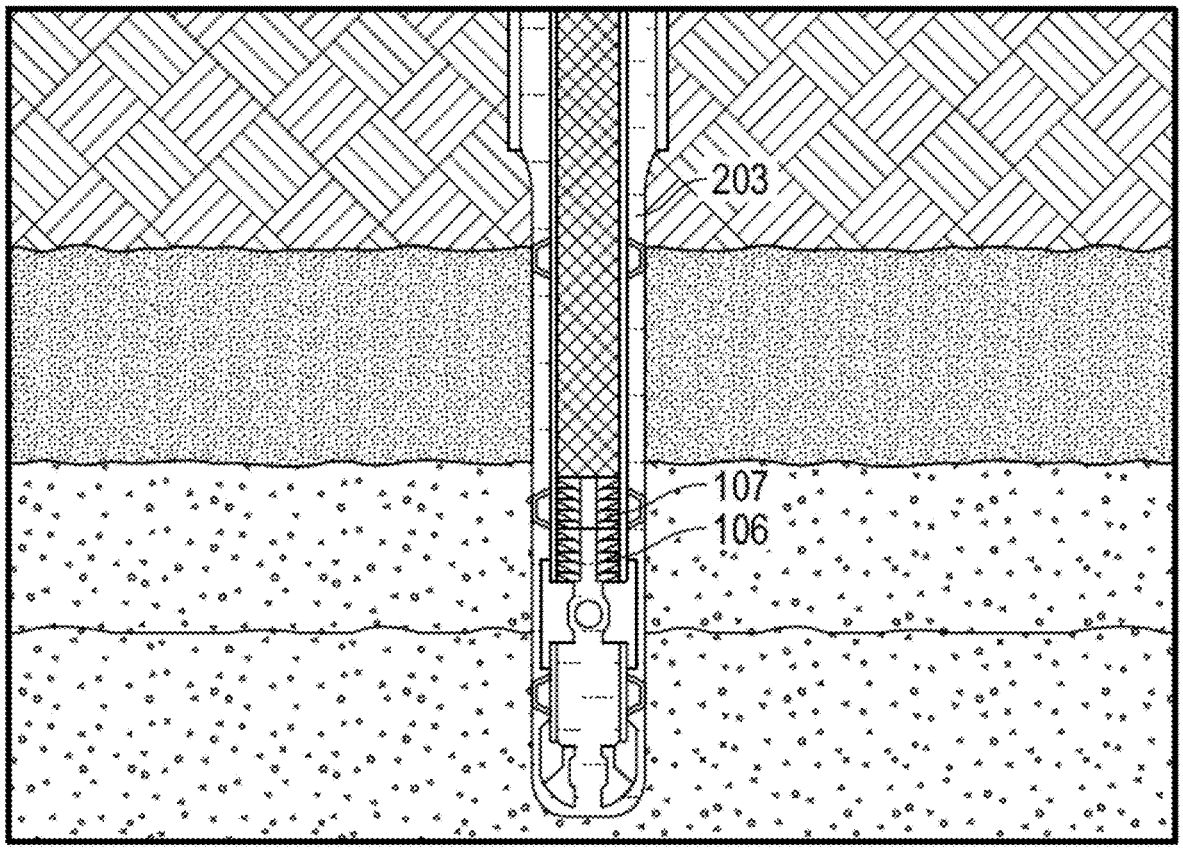
FIG. 4 shows a completed cementing operation. Cement slurry fills the annulus, both cementing plugs have landed on the float collar, and the interior of the casing string is filled with displacement fluid.

In an aspect, embodiments relate to methods for determining a position of a droppable object inside a casing string. The droppable object may be a cementing plug or a drillpipe dart. Hereinafter, the terms "droppable object," "plug" and "dart" may be used interchangeably. A casing string is installed into a liquid filled borehole, during which a fluid in the borehole enters and fills an interior of the casing string. The casing string comprises at least one region with a negative or a positive change of inner cross-sectional dimension. A pressure data acquisition system is installed at the wellsite, and at least one pressure transducer is installed at the casing string. A droppable object is placed inside the casing string. A displacement fluid is pumped behind the droppable object, causing the droppable object to travel through the interior of the casing string and pass through the at least one region with a negative or positive change of inner cross-sectional dimension, thereby generating a pressure pulse. The at least one pressure transducer is used to detect and record the pressure pulse and transmit pressure data to the pressure data acquisition system. The pressure data comprises the pressure pulses generated by the droppable object passing casing collars, reflected pressure pulses or a combination thereof. The pressure data are processed mathematically and the position of the droppable object is determined. The mathematical processing comprises fusion of the pressure data by a Kalman filter.

In a further aspect, embodiments relate to methods for cementing a borehole penetrating a subterranean formation. A casing string is installed into a liquid filled borehole, during which a fluid in the borehole enters and fills an interior of the casing string. The casing string comprises at least one region with a negative or a positive change of inner cross-sectional dimension. A pressure data acquisition system is installed at the wellsite, and at least one pressure transducer is installed at the casing string. A cement slurry is pumped into the interior of the casing string. A cementing plug is placed inside the casing string. A displacement fluid is pumped behind the cementing plug, causing the cementing plug to travel through the interior of the casing string and pass through the at least one region with a negative or positive change of inner cross-sectional dimension, thereby generating a pressure pulse. The at least one pressure transducer is used to detect and record the pressure pulse and transmit pressure data to the pressure data acquisition system. The pressure data comprises the pressure pulses generated by the cementing plug passing casing collars, reflected pressure pulses or a combination thereof. The pressure data are processed mathematically and the position of the droppable object is determined. The mathematical processing comprises fusion of the pressure data by a Kalman filter.

DETAILED DESCRIPTION

At the outset, it should be noted that in the development of any such actual embodiment, numerous implementations—specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary of the disclosure and this detailed description, each numerical value should be read once as modified by the term "about" (unless already expressly so modified), and then read again as not so modified unless otherwise indicated in context. Also, in the summary of the disclosure and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific points, it is to be understood that inventors appreciate and understand that any and all data points within the range are to be considered to have been specified, and that inventors possessed knowledge of the entire range and all points within the range.

This disclosure pertains to methods for detecting in real time the position of droppable objects in a casing string or liner during a well cementing operation. Droppable objects may be cementing plugs or drillpipe darts. In this disclosure, the terms "plug" and "dart" may be used interchangeably with "droppable object."

The method is based on employing a Kalman filter to perform a data fusion of different plug position measurements, with predictions of the volumetric model, resulting in a position estimate that is more accurate than those based on a single measurement. This is achieved by estimating a joint probability distribution over the measurement results for each timeframe.

A list of possible measurements may include, but not be limited to: (1) plug position and casing diameter determination by speed matching with the object speed determined by volumetric methods; (2) plug position determination by correlating pressure pulses with the casing tally; and (3) plug position determination by reflected signal processing by cepstrum analysis. The pulses may be determined by spectral analysis of high-resolution cement-head pressure data.

Figure 5:
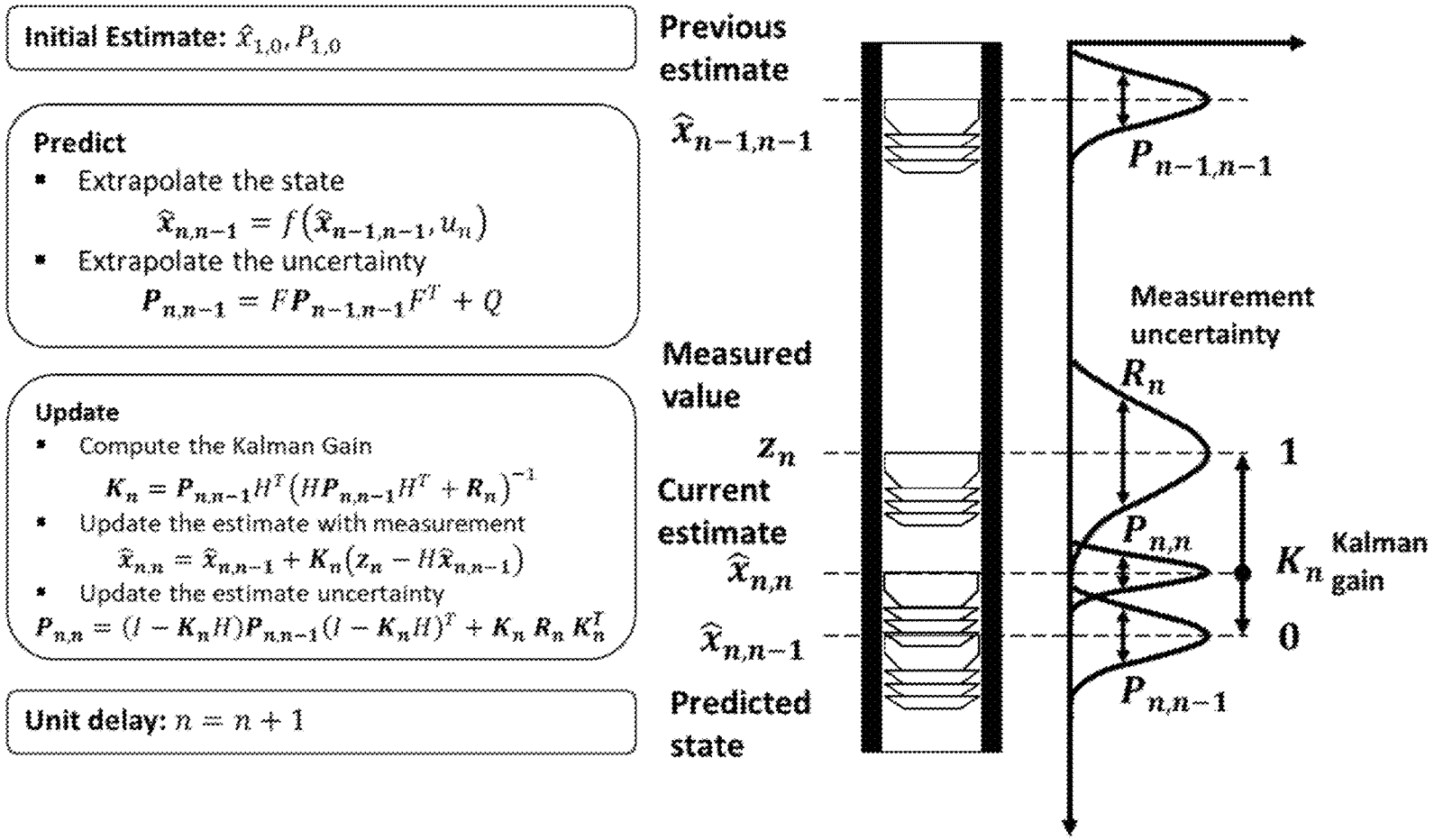
FIG. 5 is a flowchart illustrating tracking of a droppable object position with a Kalman filter.

The algorithm works in a two-step process (FIG. 5). In the prediction step, the Kalman filter produces an a priori system state measurement along with its uncertainty. The prediction is made by the volumetric model. The system state vector $$\hat{x} = \begin{bmatrix} h \\ d \end{bmatrix}$$

estimates the plug position h and the inner casing diameter d.

When any of the above measurements (possibly contaminated with the measurement noise) are observed, the estimates are continually updated using a weighted average, with more weight being given to estimates with lower uncertainty. The process is repeated at every time step n.

The model prediction and measurement update steps are presented in greater detail below.

Prediction Step

Figure 6:
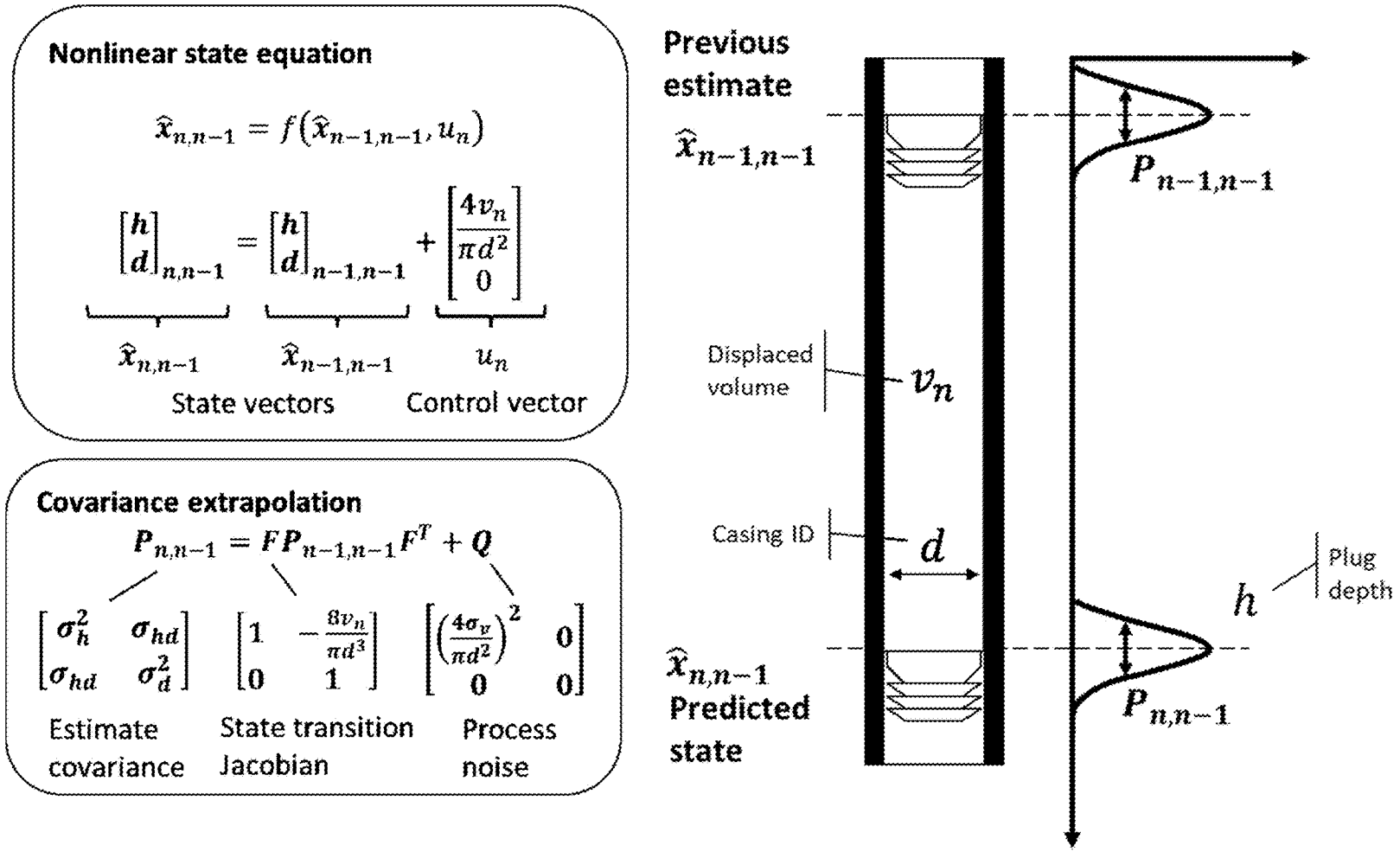
FIG. 6 is a flowchart illustrating the prediction step of tracking a droppable object with a Kalman filter.

The prediction step of the plug tracking with Kalman filter is illustrated in FIG. 6. The nonlinear volumetric plug tracking model is $\hat{x}_{n,n-1}=f(\hat{x}_{n-1,n-1},u_n)$ predicts the new a priori system state vector $\hat{x}_{n,n-1}$ as a summation of previous estimation $\hat{x}_{n-1,n-1}$ and control vector $$u_n = \begin{bmatrix} \frac{4v_n}{\pi d^2} \\ 0 \end{bmatrix}.$$

The first element of the control vector, un, determines the distance that the plug travels along the well being displaced by the volume of the displacement fluid $v_n$. For simplicity, the inner casing diameter d is assumed to be constant at each step of the Kalman algorithm, so the second element of the control vector is equal to 0. In case of an inner casing diameter change, the second element will be equal to the casing diameter increment or decrement. The control vector term $u_n$ introduces nonlinearity into the model equation. Modification of the Kalman filter applied to nonlinear problems is called an Extended Kalman filter.

The system state uncertainty is described by the covariance matrix:

$$P = \begin{bmatrix} \sigma_h^2 & \sigma_{hd} \\ \sigma_{hd} & \sigma_d^2 \end{bmatrix}.$$

The diagonal elements of the covariance matrix $\sigma_h^2$ and $\sigma_d^2$ are variances of the plug position h and casing inner diameter d. The off-diagonal elements $\sigma_{hd}$ are their covariances.

According to the Extended Kalman filter algorithm the previous covariance estimate $P_{n-1,n-1}$ is extrapolated to the new estimate $P_{n,n-1}$ by the following equation:

$$P_{n,n-1}=FP_{n-1,n-1}F^T+Q.$$

F is the Jacobian matrix with partial derivatives of f by h and d as its elements:

$$F = \begin{bmatrix} \frac{\partial f_h}{\partial_h} & \frac{\partial f_h}{\partial_d} \\ \frac{\partial f_d}{\partial_h} & \frac{\partial f_d}{\partial_d} \end{bmatrix}.$$

Here, $f_h$ and $f_d$ are two outputs of the volumetric plug tracking model f. Q is a process noise covariance. The process noise covariance describes the input of the predicted plug position uncertainty due to pumped volume measurement variance $\sigma_v$.

Update Step

The measurement vector $z_n$ is also a two-element vector comprising a plug position and casing inner diameter:

$$z = \begin{bmatrix} h \\ d \end{bmatrix}.$$

Figure 7:
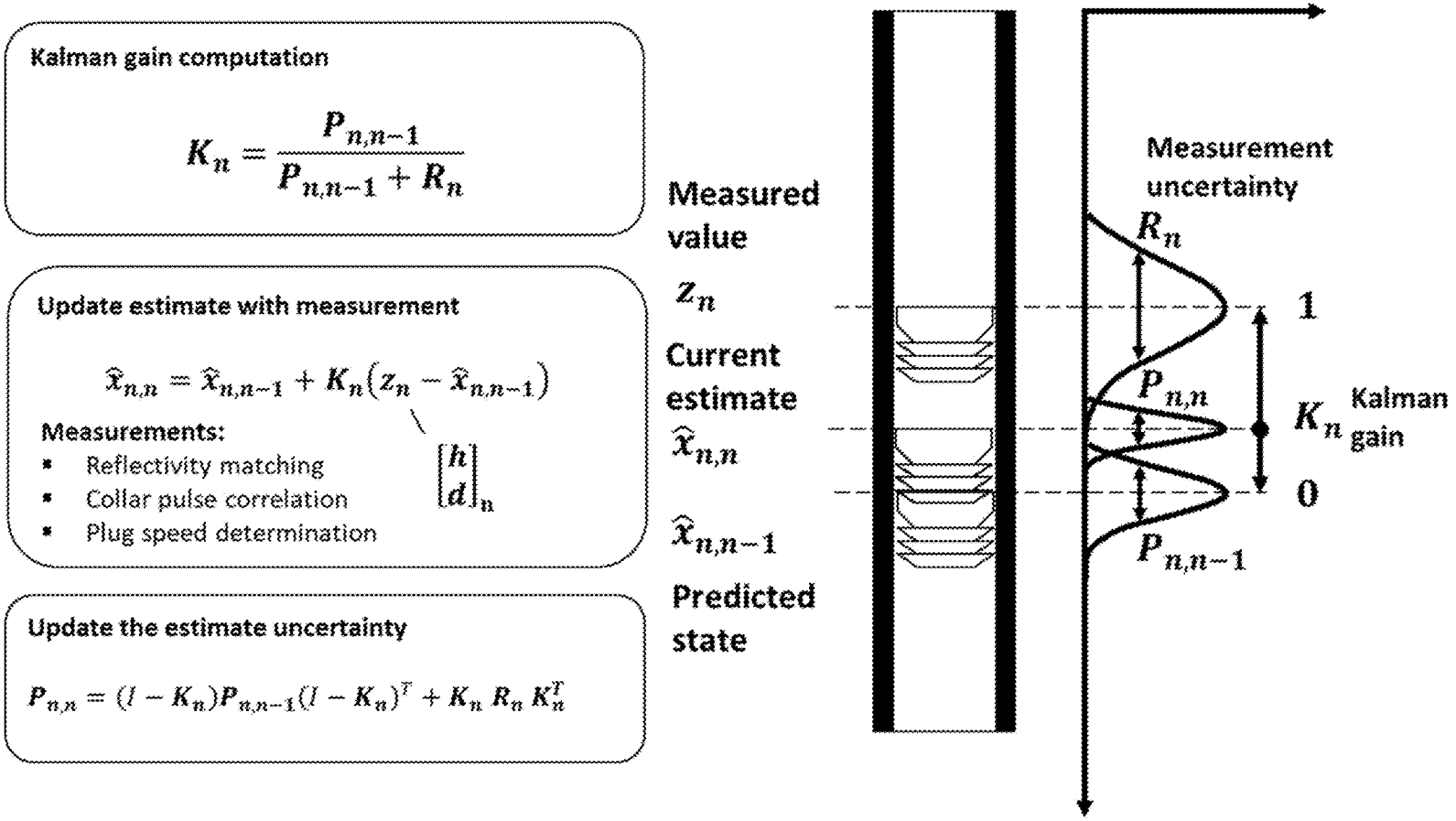
FIG. 7 is a flowchart illustrating the update step of tracking a droppable object with a Kalman filter.

The measurement uncertainty is defined by covariance matrix R, that has the same structure as the estimate covariance P defined previously. The measurement $z_n$ is fused with the predicted state $\hat{x}_{n,n-1}$ in form of their weighted average that results in a current state estimate $\hat{x}_{n,n}$ (FIG. 7).

$$\hat{x}_{n,n}=\hat{x}_{n,n-1}+K_n(z_n-\hat{x}_{n,n-1}).$$

Here the weighted average is defined by the Kalman gain matrix:

$$K_n = \frac{P_{n,n-1}}{P_{n,n-1} + R_n}.$$

The diagonal elements of the Kalman gain matrix range from 0 to 1. A low measurement uncertainty $R_n$ relative to the model prediction uncertainty $P_{n,n-1}$ will increase the Kalman gain toward 1. As a result, the current state estimate $\hat{x}_{n,n}$ will be closer to the measurement $z_n$. Conversely, a low model prediction uncertainty $P_{n,n-1}$ relative to the measurement uncertainty $R_n$ will decrease the Kalman gain toward 0. As a result, the current state estimate $\hat{x}_{n,n}$ will be closer to the predicted state $\hat{x}_{n,n-1}$.

The current estimate covariance $P_{n,n}$ is a combination of the model prediction uncertainty $P_{n,n-1}$ and the measurement uncertainty $R_n$:

$$P_{n,n}=(I-K_n)P_{n,n-1}(I-K_n)^T+K_nR_nK_n^T.$$

Here, I is a unit matrix.

Fusion of Collar Pulse Measurement

Figure 8:
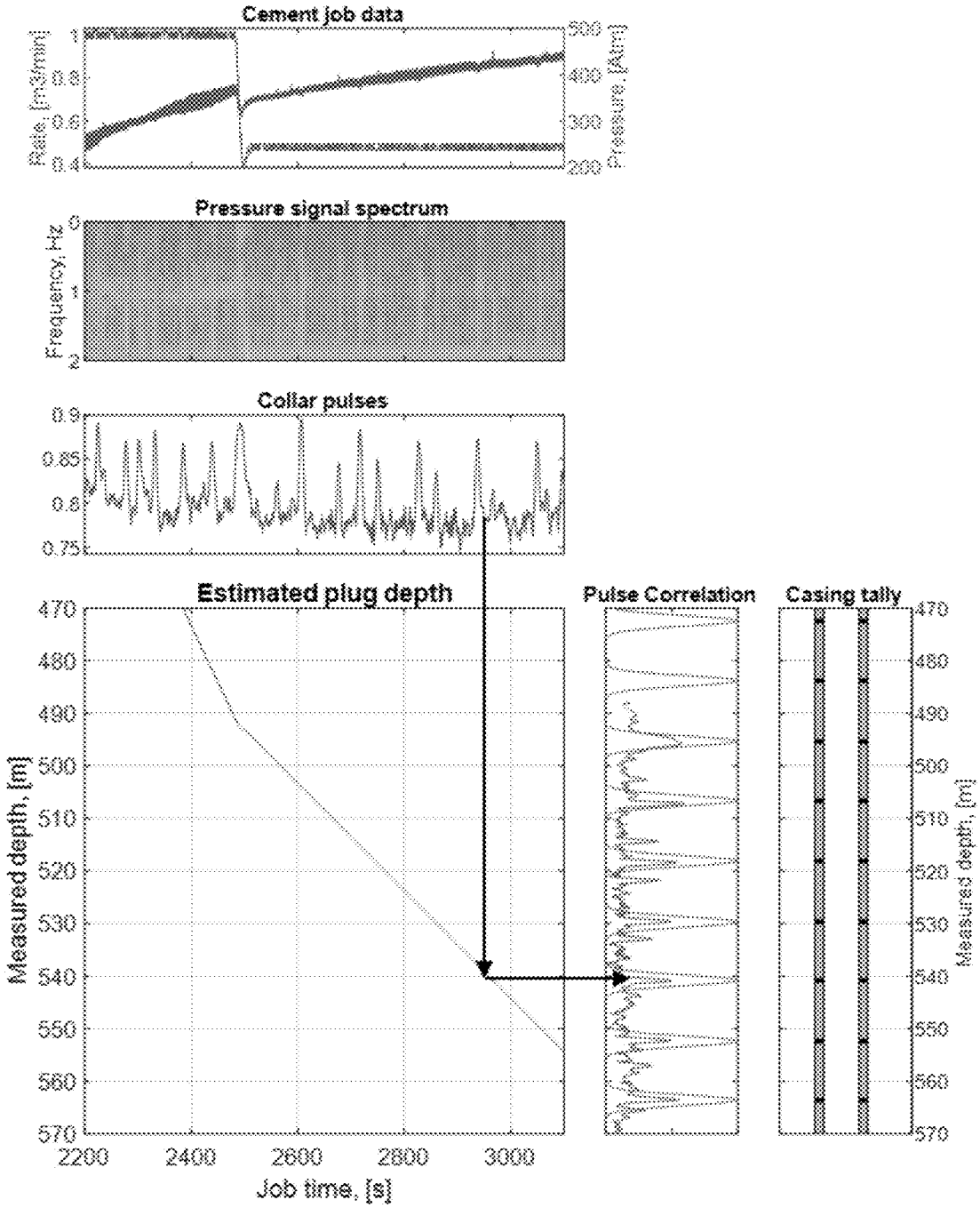
FIG. 8 illustrates a top plug position measurement based on collar pulse correlation.

The patent application PCT/RU2019/000600, "Methods for Determining a Position of a Droppable Object in a Wellbore," teaches the following steps for the top cement plug determination (FIG. 8).

1. Compute short-time Fourier transform (STFT) of the cement head pressure signal.
2. Identify collar pulses on normalized energy spectral density plot.
3. Map the collar pulses from time scale to estimated depth scale.

4. Correlate the measured collar pulses with the predicted ones.
5. Apply a depth correction to the estimated plug depth.

To be able to enter the collar pulse correlation measurements into the Kalman filter algorithm, the measurement vector $$z = \begin{bmatrix} h \\ d \end{bmatrix}$$

and its covariance $R_{hd}$ are defined. The unknown inner casing diameter d required by the Kalman algorithm can be computed from the volumetric equation:

$$d = \sqrt{\frac{4v}{\pi h}}.$$

Here, v is the displacement volume with standard deviation of $\sigma_v$ and h is the measured plug position with standard deviation of $\sigma_h$.

The Kalman filter algorithm requires a Gaussian distribution of the measurement data, which might not be true for the collar pulse correlation method if all casing joints have nearly the same length. However, the distributions of plug position h and inner casing diameter d can be assumed to be Gaussian if two conditions are met.

1. The initial plug position determined volumetrically is close enough to the true position.
2. The correlation lag is small: e.g. less than half of casing joint length.

The measurement vector z can be defined as an output of function of the displacement volume v and the plug position h:

$$z = g(v, h) = \begin{bmatrix} g_h \\ g_d \end{bmatrix}.$$

Their covariance in linear approximation may be expressed as:

$$R_{hd} = GR_{vh}G^T,$$

with the Jacobian matrix $$G = \begin{bmatrix} \frac{\partial g_h}{\partial v} & \frac{\partial g_h}{\partial h} \\ \frac{\partial g_d}{\partial v} & \frac{\partial g_d}{\partial h} \end{bmatrix}$$

and the covariance matrix $R_{vh}$ of input parameters of the displacement volume v and the plug position h.

Fusion of Speed Matching Measurements

Figure 9:
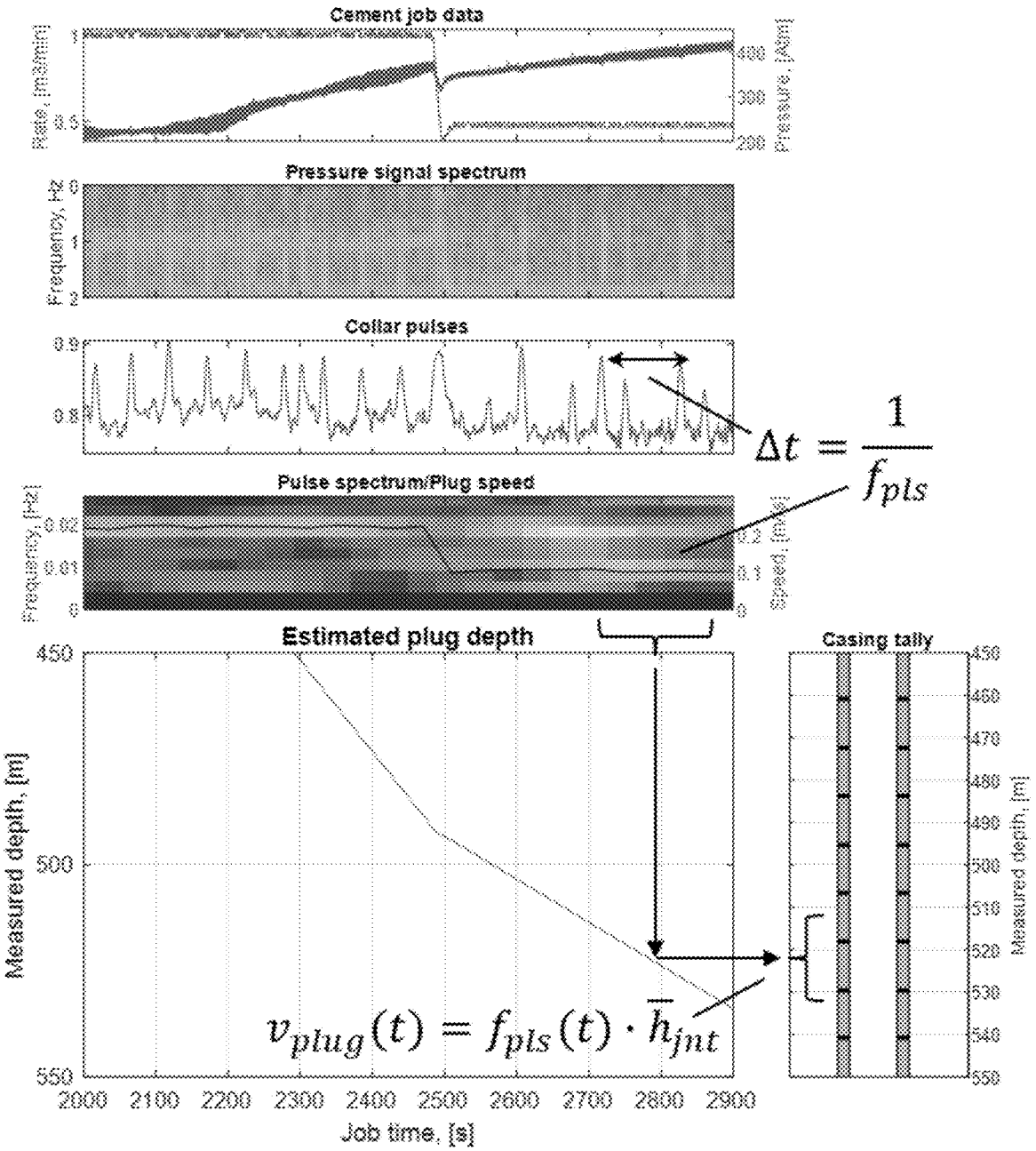
FIG. 9 illustrates a casing diameter measurement based on speed matching.

The speed matching method utilizes a similar idea of using pulses induced by plug passing the casing collar, but it is free of the non-Gaussian measurement error distribution intrinsic to the collar pulse correlation method (FIG. 9).

The speed matching method involves the following.

1. Compute the Short Time Fourier Transform (STFT) of the pressure signal.
2. Identify the collar pulses on the normalized energy spectral density plot.
3. Determine the pulsation frequency $f_{pls}(t)$ by application of the STFT to the collar pulse plot.
4. Determine the plug speed $v_{plug}(t)$ by multiplying the pulsation frequency $f_{pls}(t)$ by the average joint length $\bar{h}_{jnt}$.
5. Determine the casing inner diameter by matching the measured flow rate Q (t) with that determined from the plug speed:

$$d = \arg\min \|Q(t) - 4\pi d^2 v_{plug}(t)\|^2.$$

6. Calculate the plug position from the casing inner diameter d and the total measured displacement volume v.

$$h = \frac{4v}{\pi d^2}.$$

Unlike the collar pulse correlation method that determines the plug location and then recalculates the casing inner diameter, the plug speed matching method determines the inner diameter first and then determines the plug position from the volumetric equation.

The measurement vector z required by Kalman algorithm can be defined as an output of function of the displacement volume v and the inner casing diameter d:

$$z = g(v, d) = \begin{bmatrix} g_h \\ g_d \end{bmatrix}.$$

Their covariance in linear approximation may be expressed as:

$$R_{hd} = GR_{vd}G^T,$$

with a Jacobian matrix:

$$G = \begin{bmatrix} \frac{\partial g_h}{\partial v} & \frac{\partial g_h}{\partial d} \\ \frac{\partial g_d}{\partial v} & \frac{\partial g_d}{\partial d} \end{bmatrix},$$

and the covariance matrix $R_{vd}$ of input parameters of the displacement volume v and the inner casing diameter d.

The algorithm may be operated in real-time by recursively using only present measurement data and the previously predicted state. No additional past information is required.

Figure 11:
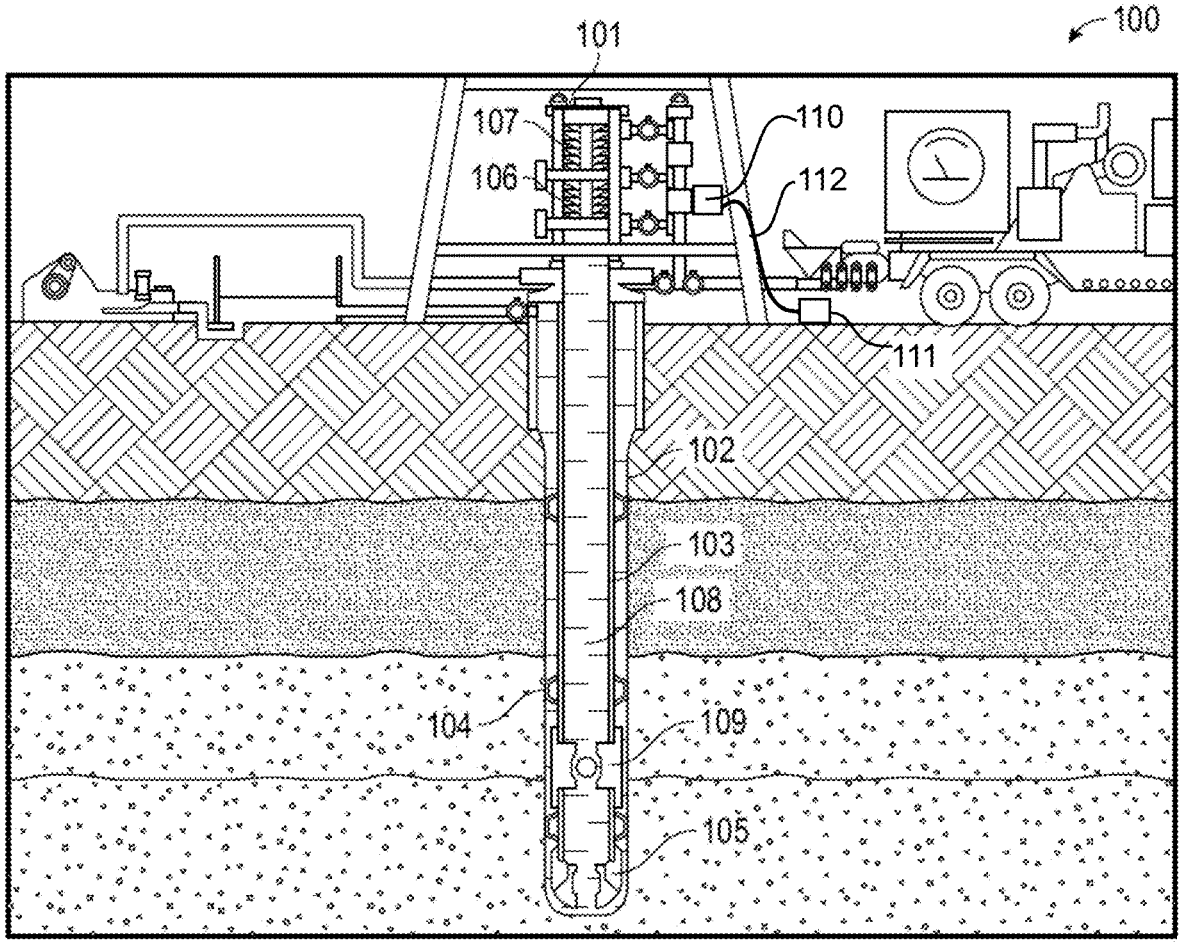
FIG. 11 shows a wellsite configuration during a cementing operation in accordance with an example embodiment of the present disclosure.

Persons skilled in the art will recognize that the disclosed methods may further comprise placing a bottom cementing plug inside the casing string. Cement slurry may be pumped behind the bottom cementing plug. The bottom cementing plug may travel through the interior of the casing string and pass through at least one region with a negative or a positive change of inner cross-sectional dimension, thereby generating a pressure pulse. At least one pressure transducer (see FIG. 11, 110) may be used to detect the pressure pulse and transmit pressure data to the pressure data acquisition system (see FIG. 11, 111). The pressure transducer 110 may communicate with the pressure data acquisition system 111 via wireless communication or via a wired connection, e.g., a cable 112. The pressure data may be processed mathematically and the position of the bottom cementing plug may be determined. Monitoring of the bottom cementing plug may proceed at least until the top cementing plug is launched.

Example

Figure 10:
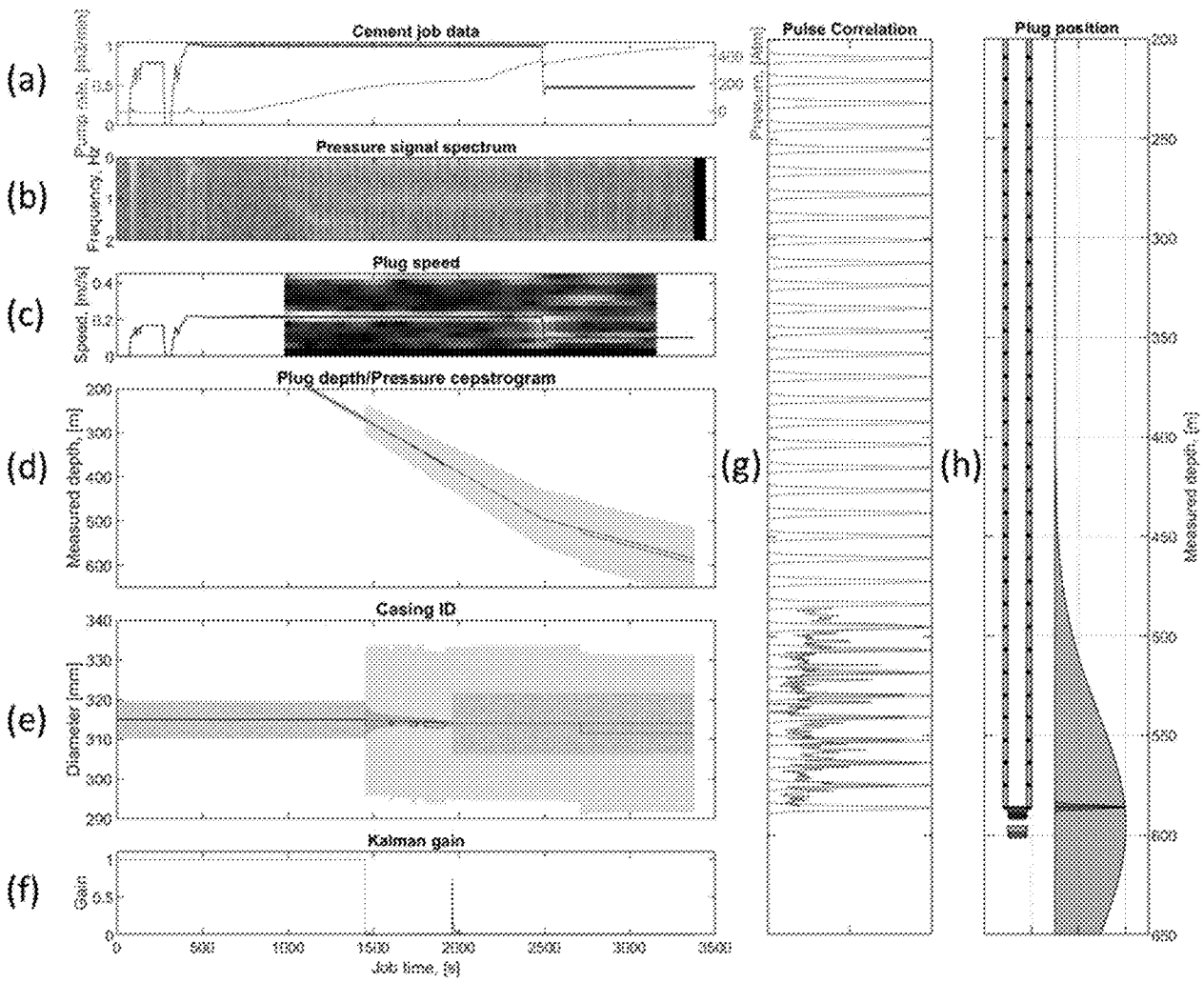
FIG. 10 illustrates an example of real-time plug tracking. Pump rate and cement head pressure (a); Pressure spectrogram (b); Plug speed matching with the one obtained from the flow rate (c); Plug trajectories and their uncertainties obtained by speed matching, pulse correlation and Kalman filter (d); Casing inner diameters and their uncertainties obtained by speed matching, pulse correlation and Kalman filter (e); Kalman gains for plug position and casing diameter (f); Collar pulse correlation with the predicted pulses (g); Plug positions and their uncertainties determined by speed matching, pulse correlation and Kalman filter at true plug setting time (h).

An example of tracking of the top cement plug for the cementing job in 13⅜-inch casing pipe with a Kalman filter is shown in FIG. 10. Cement head pressure and flow rate are shown in FIG. 10(*a*). The pressure spectrogram is shown in FIG. 10(*b*). No pressure signal was available at the beginning of the job from 0 to about 1000 seconds due to the U-tubing effect. In that time period the plug position was tracked basing on the volumetric model only. The plug trajectory as a function of time is shown in FIG. 10(*d*). The standard deviation of plug location is shown as a shaded area. The standard deviation of the plug location predicted by the volumetric model increased from 0 to 8 meters due to process noise related to flowmeter measurement noise and inner casing diameter uncertainty. The casing inner diameter measurements with standard deviations are plotted as shaded areas in FIG. 10(*e*). The casing inner diameter did not change from its initial value and its standard deviation was constant as per the volumetric model prediction.

The speed matching measurement fusion began at 1453 s. The pressure pulse spectrogram plotted in the plug speed scale and the matched plug speed computed from the flow rate are shown in FIG. 10(*c*). Although the standard deviation of the plug location determined by the speed matching varied from 33.1 to 81.1 m, its fusion with the Kalman filter effectively reduced the estimated standard deviation of the plug location from 8 to 2 meters. Additionally, fusion of the speed matching changed the estimated inner casing diameter from an initial value of 314.9 mm to 314.0 mm. Again, although the standard deviation of the inner casing diameter measured by speed matching fluctuated around 19 mm, the standard deviation of the Kalman estimate was effectively reduced from 4.7 mm to 0.8 mm. The values for the Kalman gain both for the plug position and casing diameter are shown in FIG. 10(*f*). When the speed matching measurements fusion began, the Kalman gain quickly fell from the default value of 1 to almost zero, indicating more weight was given to the model prediction rather than to the measurement.

To validate the algorithm the estimated plug depth is compared to the landing depth at true landing time. The true landing depth is equal to the depth of the float collar (586.3 m for this case). The true landing time is defined as pressure pick up time caused by the plug landing.

The plug positions and their probability distributions at true landing time determined by the speed matching, collar pulse correlation and Kalman filter are shown in FIG. 10(*h*).

The differences between the estimated plug positions and true landing depths along with their standard deviations are listed in Table 1.

TABLE 1

Differences and standard deviations between plug positions determined by volumetric, speed matching, collar pulse correlation and Kalman filter methods.

| | Volumetric | Speed Matching | Collar Pulse Correlation | Kalman Filter |
|---|---|---|---|---|
| Difference, m | 3.53 | 9.11 | −0.41 | −0.52 |
| Standard deviation, m | 16.4 | 81.1 | 1.2 | 0.43 |

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

The invention claimed is:

1. A method for determining a position of a droppable object inside a casing string, the method comprising:

(i) installing the casing string into a liquid filled borehole, during which a fluid in the borehole enters and fills an interior of the casing string, the casing string comprising at least one region with a negative or a positive change of inner cross-sectional dimension proximate to a casing collar;

(ii) installing:

a pressure data acquisition system at a wellsite; and at least one pressure transducer at the casing string;

(iii) placing the droppable object inside the casing string;

(iv) pumping a displacement fluid behind the droppable object, causing the droppable object to travel through the interior of the casing string and pass through and contact the at least one region with a negative or a positive change of inner cross-sectional dimension, the contact thereby directly generating one or more pressure pulses in the fluid;

(v) using the at least one pressure transducer to detect and record pressure data related to the one or more pressure pulses and transmit the pressure data to the pressure data acquisition system, the pressure data comprising data corresponding to the one or more pressure pulses directly generated by the droppable object passing the casing collars, one or more reflected pressure pulses reflected directly from the droppable object, or a combination thereof; and (vi) processing the pressure data mathematically and determining a position of the droppable object via the pressure data acquisition system, wherein the mathematical processing comprises fusion of the pressure data by a Kalman filter.

2. The method of claim 1, wherein the Kalman filter comprises;

a model prediction step; and a measurement fusion step.

3. The method of claim 2, wherein the model prediction step comprises a volumetric method of determining the position of the droppable object.

4. The method of claim 2, wherein the measurement fusion step comprises a speed matching measurement, a collar pulse correlation measurement, or a cepstrum analysis measurement, or a combination thereof.

5. The method of claim 1, wherein the droppable object comprises a cementing plug or a dart.

6. A method for cementing a borehole penetrating a subterranean formation, the method comprising:

(i) installing a casing string into a liquid filled borehole, during which a fluid in the borehole enters and fills an interior of the casing string, the casing string comprising at least one region with a negative or a positive change of inner cross-sectional dimension proximate to a casing collar;

(ii) installing:

a pressure data acquisition system at a wellsite; and at least one pressure transducer at the casing string;

(iii) pumping a cement slurry into the interior of the casing string;

(iv) placing a cementing plug inside the casing string;

(v) pumping a displacement fluid behind the cementing plug, causing the cementing plug to travel through the interior of the casing string and pass through and contact the at least one region with a negative or a positive change of inner cross-sectional dimension, the contact thereby directly generating one or more pressure pulses in the fluid;

(vi) using the at least one pressure transducer to detect and record pressure data related to the one or more pressure pulses and transmit the pressure data to the pressure data acquisition system, the pressure data comprising data corresponding to the one or more pressure pulses directly generated by the droppable object passing the casing collars, one or more reflected pressure pulses reflected directly from the droppable object, or a combination thereof; and (vii) processing the pressure data mathematically and determining a position of the cementing plug via the pressure data acquisition system, wherein the mathematical processing comprises fusion of the pressure data by a Kalman filter.

7. The method of claim 6, wherein the Kalman filter comprises a model prediction step and a measurement fusion step.

8. The method of claim 7, wherein the model prediction step comprises a volumetric method of determining the position of the cementing plug.

9. The method of claim 7, wherein the measurement fusion step comprises a speed matching measurement, a collar pulse correlation measurement, or a cepstrum analysis measurement, or a combination thereof.

* * * * *